US011930970B2

(12) United States Patent
McNulty et al.

(10) Patent No.: US 11,930,970 B2
(45) Date of Patent: Mar. 19, 2024

(54) DISPENSERS AND DISPENSER SYSTEMS FOR PRECISELY CONTROLLED OUTPUT DOSING OF SOAP OR SANITIZER

(71) Applicant: GOJO Industries, Inc., Akron, OH (US)

(72) Inventors: John J. McNulty, Broadview Heights, OH (US); Donald R. Harris, Cuyahoga Falls, OH (US); Mark A. Bullock, Wooster, OH (US); Chip W. Curtis, La Moille, IL (US)

(73) Assignee: GOJO Industries, Inc., Akron, OH (US)

( * ) Notice: Subject to any disclaimer, the term of this patent is extended or adjusted under 35 U.S.C. 154(b) by 0 days.

(21) Appl. No.: 18/056,280

(22) Filed: Nov. 17, 2022

(65) Prior Publication Data

US 2023/0081854 A1 Mar. 16, 2023

Related U.S. Application Data

(63) Continuation of application No. 17/336,655, filed on Jun. 2, 2021, now Pat. No. 11,596,271.
(Continued)

(51) Int. Cl.
*A47K 5/12* (2006.01)

(52) U.S. Cl.
CPC ..... *A47K 5/1208* (2013.01)

(58) Field of Classification Search
CPC ..... A47K 5/1208; A47K 5/12; A47K 5/14; A47K 5/1217
See application file for complete search history.

(56) References Cited

U.S. PATENT DOCUMENTS 7,611,030 B2 * 11/2009 Reynolds ..... A47K 5/1208 222/25
7,621,426 B2 11/2009 Reynolds et al.
(Continued)

FOREIGN PATENT DOCUMENTS

CA 2635169 A1 * 12/2008 ..... A47K 5/1217
CA 2967107 A1 * 8/2010 ..... A47K 5/1204
(Continued)

OTHER PUBLICATIONS

International Search Report and Written Opinion from PCT/US2021/035414 dated Aug. 20, 2021.

*Primary Examiner* — Bob Zadeh
(74) *Attorney, Agent, or Firm* — Calfee, Halter & Griswold LLP

(57) ABSTRACT

Exemplary power systems for dynamically controlling a dispenser drive motor for dispensing soap, sanitizing or lotion. An exemplary soap, sanitizing or lotion dispenser includes a housing, a receptacle for receiving a container for holding a soap, sanitizing or lotion, a container of soap, sanitizing or lotion and a pump secured to the container. The exemplary soap, sanitizing or lotion dispenser includes a power source, a motor and an actuator that couples the motor to the pump. In addition, the exemplary soap, sanitizing or lotion dispenser includes pulse width modulation circuitry in circuit communication with the power source and the motor. Movement of the actuator one actuation cycle dispenses a dose of soap, sanitizing or lotion. The pulse width modulation circuitry provides a plurality of voltage pulses to the motor to move the actuator one actuation cycle.

20 Claims, 5 Drawing Sheets

Related U.S. Application Data

(60) Provisional application No. 63/033,892, filed on Jun. 3, 2020.

(56) References Cited

U.S. PATENT DOCUMENTS

| | | | | |
|---|---|---|---|---|
| 7,837,066 | B2 | 11/2010 | Reynolds et al. | |
| 7,909,209 | B2 | 3/2011 | Reynolds et al. | |
| 8,087,543 | B2 * | 1/2012 | Yang | A47K 5/1217 222/642 |
| 8,960,498 | B2 | 2/2015 | Wegelin et al. | |
| 9,172,266 | B2 | 10/2015 | Curtis et al. | |
| 9,943,196 | B2 | 4/2018 | Mak et al. | |
| 10,022,024 | B2 | 7/2018 | Ciavarella et al. | |
| 10,065,199 | B2 | 9/2018 | Twaroski et al. | |
| 10,080,466 | B2 | 9/2018 | Ciavarella et al. | |
| 10,080,467 | B2 | 9/2018 | Ciavarella et al. | |
| 10,080,468 | B2 | 9/2018 | Ciavarella et al. | |
| 10,143,339 | B2 | 12/2018 | Ciavarella et al. | |
| 2006/0226799 | A1 | 10/2006 | Lin et al. | |
| 2010/0006597 | A1 | 1/2010 | Reynolds et al. | |
| 2010/0288788 | A1 * | 11/2010 | Ophardt | A47K 5/1207 222/1 |
| 2014/0217123 | A1 * | 8/2014 | Ophardt | A47K 5/1217 222/190 |
| 2016/0068383 | A1 * | 3/2016 | Falco, III | B67D 1/0888 222/25 |
| 2016/0309967 | A1 * | 10/2016 | Pelfrey | A47K 5/1217 |
| 2017/0049276 | A1 * | 2/2017 | Lightner | B05B 11/0054 |
| 2019/0089756 | A1 | 3/2019 | Wissingh et al. | |
| 2019/0133384 | A1 | 5/2019 | McNulty et al. | |
| 2021/0378458 | A1 | 12/2021 | McNulty et al. | |
| 2023/0081854 | A1 * | 3/2023 | McNulty | A47K 5/1208 222/71 |

FOREIGN PATENT DOCUMENTS

| | | | | |
|---|---|---|---|---|
| CA | 2776684 | A1 * | 11/2013 | A47K 5/12 |
| EP | 1320185 | A2 | 6/2003 | |
| WO | 2019089756 | A1 | 5/2019 | |

* cited by examiner

25% Duty Cycle

50% Duty Cycle

DISPENSERS AND DISPENSER SYSTEMS FOR PRECISELY CONTROLLED OUTPUT DOSING OF SOAP OR SANITIZER

RELATED APPLICATIONS

The present application is a continuation of U.S. patent application Ser. No. 17/336,655, filed on Jun. 2, 2021, which claims priority to and the benefits of U.S. Provisional Patent Application Ser. No. 63/033,892, filed on Jun. 3, 2020, both of which are incorporated by reference herein in their entireties.

TECHNICAL FIELD

The present invention relates generally to touch free soap and sanitizer dispenser systems and more particularly dispensers that have precisely controlled output dosing of soap or sanitizer.

BACKGROUND OF THE INVENTION

In hands-free (or touch-free) dispensers, a liquid or foam pump is typically activated by an actuator that drives the pump through a drive cycle to dispense a dose of fluid. The liquid pumps and foam pumps primarily used in today's soap and sanitizer dispensers are dome pumps and piston pumps. A few dispensers utilized rotary displacement pumps.

Rotary displacement pumps, which are pumps that have a plurality of rollers on a wheel that rotate and compress a dispense tube (these pumps are often used in devices such as, for example, intravenous drip systems) have fairly precise dose sizes, however the dispense speeds are not practical for dispensing a dose of soap or sanitizer. In addition, creating foam soap or sanitizer with a rotary displacement pump is not feasible due to the speed of dispense required.

Some prior art dispensers deliver a dose of fluid based on time, such as, for example, 1 second of "on time" results in the dose dispensed. As a result, the battery voltage in the dispenser has an impact on the amount of fluid dispensed. As the battery voltage drops, the pump motor does not rotate as fast and accordingly, less fluid is dispensed as the batteries age.

Most prior art dispensers dispense a single "shot" of liquid and/or a single shot of liquid and a single shot that are mixed together to form a foam. In other words, a single liquid pump chamber is filled with liquid and dispensed for each dose of soap or sanitizer in a liquid format or a foam format. A single liquid pump chamber may not completely fill or completely empty when the dispenser dispenses a dose of soap or sanitizer. Accordingly, a single liquid pump chamber that dispenses a single shot of liquid often has inconsistent liquid dispense dose sizes.

In the prior art dispensers, the "average dose" size dispensed over a number of dispenses for these pumps may be fairly consistent, however, the individual volume or dose size of each individual dispense often varies. For example, the average dispense dose volume, may be, for example, 1.2 milliliters per dispense over ten dispenses, however, the individual dose volumes that make up that average may vary from, for example, 1.0 to 1.4 milliliters per dispense dose. There are various factors that lead to dose inconsistency, such as, for example, different vacuum pressures within the container holding the fluid, the pumps not fully priming, manufacturing variances between individual pumps, the level of fluid in the refills, the amount of time between dispenses, motor overrun, battery charge, pump life cycle, etc.

In order to overcome dosing inconsistencies, one may decide to set the dispense volume to a higher dispense volume to ensure that at least a selected minimum volume is dispensed each time. This practice typically results in dispensing more fluid than is actually required during many of the individual dispense cycles. This practice may be referred to as overdosing. Overdosing results in a fewer number of dispenses per refill unit (or per container fill-up), which increases operating costs and costs associated with replacing the refills or refilling containers. In addition, many people cause dispensers to dispense multiple dispenses of fluid per use, which further results in increased costs and more frequent replacement of refill units. Therefore, a need exists for a dispenser that has a more accurately or precisely controlled dispense volume and dispenses that selected volume of fluid in a short period of time.

SUMMARY

Exemplary soap, sanitizer, and lotion dispensers are disclosed herein. An exemplary soap or sanitizer dispenser includes a housing, a container for holding fluid, a pump in fluid communication with the interior of the container, a dispenser processor, a power source, a motor, an encoder, pulse width modulation circuitry in circuit communication with the power source and the motor, and a brake. The encoder provides a plurality of signals to the processor for each rotation of the motor. The processor determines the speed of the motor a plurality of times throughout each rotation of the motor. The pulse width modulation circuitry adjusts the duty cycle to maintain a selected speed. In addition, the processor causes the brake to be applied after a set number of rotations of the motor.

Another exemplary soap or sanitizer dispenser includes a housing, a container for holding fluid, a pump in fluid communication with the interior of the container, a dispenser processor, a power source and a stepper motor. Each full rotation of the stepper motor is divided into a number of equal steps. The processor determines a number of rotations of the stepper motor as a function of the steps. The processor determines a speed of the stepper motor as a function of the steps. Pulse width modulation circuitry is also included. The pulse width modulation circuitry adjusts the duty cycle to maintain a selected speed and he processor causes the motor to stop a set number of rotations of the motor.

Another exemplary soap or sanitizer dispenser includes a housing, a receptacle for receiving a container having soap or sanitizer located at least partially within the housing. A pump is in fluid communication with the interior of the container. The dispenser further includes a dispenser processor, a power source, a motor, an encoder, and pulse width modulation circuitry in circuit communication with the processor, the power source and the motor.

An exemplary methodology for dispensing soap or sanitizer includes providing a dispenser having a container for holding fluid, a motor, a pump driven by the motor, a power source, an object sensor, a processor, an encoder and pulse width modulation circuitry. The methodology further includes detecting the presence of an object by the object sensor, causing the pulse width modulation circuitry to output a power signal with a first duty cycle to the motor, receiving a plurality of signals from the encoder that are indicative of the speed of the motor and changing from the first duty cycle to one or more second duty cycles to cause the speed of the motor to approach a selected motor speed. When the pump is driven by the motor, fluid is pumped out of the dispenser. The methodology further includes determining a number of revolutions of the motor and causing the pulse with modulation circuitry to stop providing power to the motor upon determining a selected number of revolutions of the motor have occurred. In some embodiment, the exemplary methodology further includes causing a brake to set to stop rotation of the motor and/or pump.

BRIEF DESCRIPTION OF THE DRAWINGS

These and other features and advantages of the present invention will become better understood with regard to the following description and accompanying drawings in which.

DETAILED DESCRIPTION

The following includes definitions of exemplary terms used throughout the disclosure. Both singular and plural forms of all terms fall within each meaning. Except where noted otherwise, capitalized and non-capitalized forms of all terms fall within each meaning.

"Circuit communication" as used herein indicates a communicative relationship between devices. Direct electrical, electromagnetic and optical connections and indirect electrical, electromagnetic and optical connections are examples of circuit communication. Two devices are in circuit communication if a signal from one is received by the other, regardless of whether the signal is modified by some other device. For example, two devices separated by one or more of the following—amplifiers, filters, transformers, optoisolators, digital or analog buffers, analog integrators, other electronic circuitry, fiber optic transceivers or satellites—are in circuit communication if a signal from one is communicated to the other, even though the signal is modified by the intermediate device(s). As another example, an electromagnetic sensor is in circuit communication with a signal if it receives electromagnetic radiation from the signal. As a final example, two devices not directly connected to each other, but both capable of interfacing with a third device, such as, for example, a CPU, are in circuit communication.

Also, as used herein, voltages and values representing digitized voltages are considered to be equivalent for the purposes of this application, and thus the term "voltage" as used herein refers to either a signal, or a value in a processor representing a signal, or a value in a processor determined from a value representing a signal.

"Signal", as used herein includes, but is not limited to one or more electrical signals, analog or digital signals, one or more computer instructions, a bit or bit stream, or the like.

"Logic," synonymous with "circuit" as used herein includes, but is not limited to hardware, firmware, software and/or combinations of each to perform a function(s) or an action(s). For example, based on a desired application or needs, logic may include a software controlled microprocessor or microcontroller, discrete logic, such as an application specific integrated circuit (ASIC) or other programmed logic device. Logic may also be fully embodied as software. The circuits identified and described herein may have many different configurations to perform the desired functions.

Values identified in the detailed description are exemplary and they are determined as needed for a particular dispenser and/or refill design. Accordingly, the inventive concepts disclosed and claimed herein are not limited to the particular values or ranges of values used to describe the embodiments disclosed herein.

Figure 1:
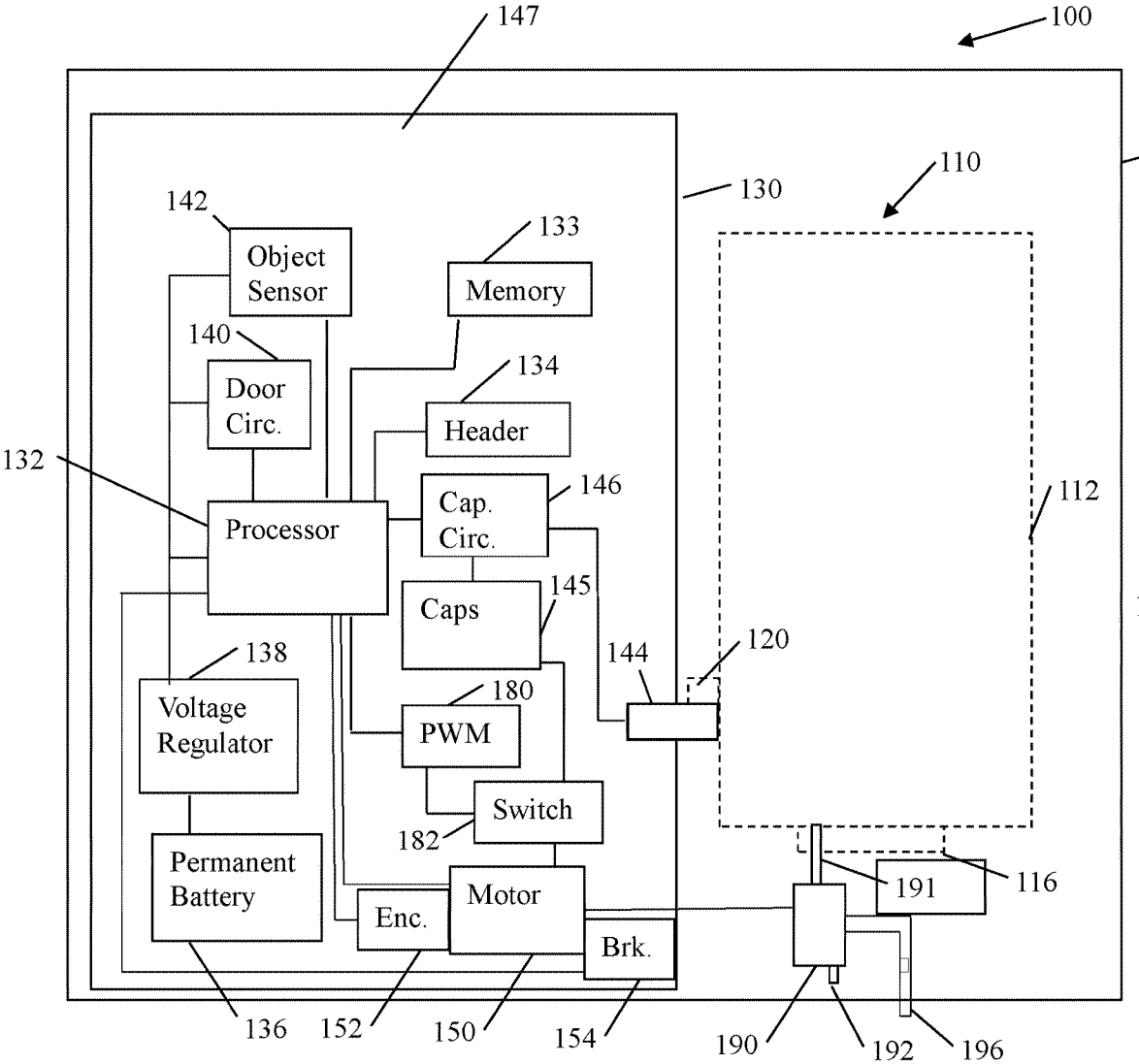
FIG. 1 is a generic illustrative schematic of an exemplary dispenser having a removable refill unit.

FIG. 1 illustrates a dispenser 100 having a precisely controlled output dose volume. Dispenser 100 includes a housing 102. Housing 102 may completely surround the components and refill unit 110 installed in dispenser as illustrated. In some embodiments, housing 102 only partially surrounds the refill unit 110. In some embodiments, housing 102 surrounds closure 116. Refill unit 110 is removable and replaceable. Refill unit 110 is illustrated in broken lines to illustrate the installed position, and in solid lines to illustrate that the refill unit 110 is removed from the dispenser 100.

Located within housing 102 is system circuitry 130. System circuitry 130 may be on a single circuit board or may be on multiple circuit boards. In addition, some of the system circuitry 130 may not be located on a circuit board, but rather may be individually mounted and electrically connected or coupled to the other components as required. In this exemplary embodiment, system circuitry 130 includes a processor 132, memory 133, an optional header 134, an optional permanent power source 136, an optional voltage regulator 138, optional door switch circuitry 140, an object sensor 142, a motor 150, an optional bank of capacitors 145, optional capacitor control circuitry 146, optional replaceable power source interface receptacle 144, optional pulse with modulation circuitry 180 and switching device 182, a motor encoder 152 and an optional brake 154.

Motor 150 drives a pump 190. In this exemplary embodiment, pump 190 is a sequentially activated rotary diaphragm foam pump, such as, for example, those identified below and incorporated herein. In this exemplary embodiment, pump 190 is a permanent pump and remains secured to the dispenser housing 102 when the refill unit 110 is removed from the dispenser 100.

In this exemplary embodiment, pump 190 is a foam pump. Pump 190 draws air in through air inlet 192 and liquid in from liquid inlet 191 (when a refill unit 110 is mounted in the dispenser 100). Pump 190 has a foam outlet 196 to dispense foam out of the dispenser 100. In some embodiments, pump 190 is a liquid pump and does not require the optional air inlet 192.

In some embodiments, pump 190 is part of, or secured to, the refill unit 110 and is removed and replaced with the refill unit. In some embodiments, the refill unit 110 is replaced with a permanent or semi-permanent container that is refilled periodically and is not removed and replaced. In this exemplary embodiment, dispenser 100 includes an encoder 152 and optional brake 154 as described in more detail below. Pump 190 is a direct drive pump and each revolution of motor 150 correlates to one pump revolution.

The sequentially activated foam pumps have a plurality of small diaphragms, such as, for example, three diaphragms or four diaphragms that expand and contract in a sequence. These pumps typically have a single liquid pump diaphragm and two or more air pump diaphragms. The diaphragms are small. In some embodiments, it takes between 10 and 30 expansions and compressions of each pump diaphragm to produce a single dose of foam soap or sanitizer. In some embodiments, it takes between 12 and 28 expansions and compressions of the pump diaphragms to produce a single dose of foam soap or sanitizer. In some embodiments, it takes between 14 and 26 expansions and compressions of the pump diaphragms to produce a single dose of foam soap or sanitizer. In some embodiments, it takes between 16 and 24 expansions and compressions of the pump diaphragms to produce a single dose of foam soap or sanitizer. In some embodiments, it takes between 16 and 20 expansions and compressions of the pump diaphragms to produce a single dose of foam soap or sanitizer. In some embodiments, it takes about 18 expansions and compressions of the pump diaphragms to produce a single dose of foam soap or sanitizer.

Having a small liquid pump chamber that must expand and compress multiple times during a single dispense of fluid helps increase the precision of the volume of output. Variables such as, for example, time between dispenses, vacuum pressure, level of fill in the refill container are minimized by use of multiple liquid pump compressions and expansions per dose of fluid. In some embodiments, the liquid pump chamber is compressed at least about 5 times for each dispense of fluid. In some embodiments, the liquid pump chamber is compressed at least about 8 times for each dispense of fluid. In some embodiments, the liquid pump chamber is compressed at least about 10 times for each dispense of fluid. In some embodiments, the liquid pump chamber is compressed at least about 12 times for each dispense of fluid. In some embodiments, the liquid pump chamber is compressed at least about 14 times for each dispense of fluid. In some embodiments, the liquid pump chamber is compressed at least about 16 times for each dispense of fluid. In some embodiments, the liquid pump chamber is compressed at least about 18 times for each dispense of fluid. In some embodiments, the liquid pump chamber is compressed at least 5 times for each dispense of fluid, but no more than about 30 times for each dispense of fluid. In some embodiments, the liquid pump chamber is compressed at least 10 times for each dispense of fluid, but no more than about 25 times for each dispense of fluid. In some embodiments, the liquid pump chamber is compressed at least 10 times for each dispense of fluid, but no more than about 22 times for each dispense of fluid. In some embodiments, the liquid pump chamber is compressed at least 10 times for each dispense of fluid, but no more than about 20 times for each dispense of fluid.

Exemplary sequentially activated diaphragm pumps and associated dispensers are shown and described in U.S. Pat. Nos. 9,943,196, 10,065,199, 10,080,466, 10,080,467, 10,143,339, and 10,080,468, which are incorporated herein in their entirety by reference.

In addition, exemplary components for touch-free dispensers are shown and described in U.S. Pat. No. 7,837,066 titled Electronically Keyed Dispensing System And Related Methods Utilizing Near Field Response; U.S. Pat. No. 9,172,266 title Power Systems For Touch-Free Dispensers and Refill Units Containing a Power Source; U.S. Pat. No. 7,909,209 titled Apparatus for Hands-Free Dispensing of a Measured Quantity of Material; U.S. Pat. No. 7,611,030 titled Apparatus for Hands-Free Dispensing of a Measured Quantity of Material; U.S. Pat. No. 7,621,426 titled Electronically Keyed Dispensing Systems and Related Methods Utilizing Near Field Response; and U.S. Pat. No. 8,960,498 titled Touch-Free Dispenser with Single Cell Operation and Battery Banking; all of which are incorporated herein by reference in their entirety. Various components of one or more of the disclosed features or components may be used in dispenser 100.

Processor 132 may be any type of processor, such as, for example, a microprocessor or microcontroller, discrete logic, such as an application specific integrated circuit (ASIC), other programmed logic device or the like. Processor 132 is in circuit communication with and optional header 134. Header 134 is a circuit connection port that allows a user to connect to system circuitry 130 to program the circuitry, run diagnostics on the circuitry and/or retrieve information from the circuitry. In some embodiments, header 134 includes wireless transmitting/receiving circuitry, such as for example, wireless RF, BlueTooth®, ANT®, or the like, configured to allow the above identified features to be conducted without a hard connection, and in some embodiments remotely.

Processor 132 is in circuit communication with memory 133. Memory 133 may be any type of memory, such as, for example, Random Access Memory (RAM); Read Only Memory (ROM); programmable read-only memory (PROM), electrically programmable read-only memory (EPROM), electrically erasable programmable read-only memory (EEPROM), flash, ROM, or the like, or combinations of different types of memory. In some embodiments, the memory 133 is separate from the processor 132, and in some embodiments, the memory 133 resides on or within processor 132.

An optional permanent power source 136, such as, for example, one or more batteries, is also provided. The permanent power source 136 is preferably designed so that the permanent power source 136 does not need to be replaced for the life of the dispenser 100. The permanent power source 136 is in circuit communication with the optional voltage regulator circuitry 138. In one exemplary embodiment, voltage regulator circuitry 138 provides regulated power to processor 132, object sensor 142, and any other component that requires regulated power. Permanent power source 136 may be used to provide power to other circuitry that requires a small amount of power and will not drain the permanent power source 136 prematurely. In the event, no permanent power source is used, or optionally even with a permanent power source, the voltage regulatory circuit 138 be connected to another source of power.

Processor 132 is also in circuit communication with optional door circuitry 140 so that processor 132 knows when the dispenser 100 door (not shown) is closed. In some embodiments, the door is a conventional door or dispenser cover that opens up to allow a user to remove and replace the refill or refill a container. In some embodiments, the "door" is merely a part of the dispenser that may be opened to access the electronics, and/or to allow removal and replacement of refill units. In some embodiments, processor 132 will not allow the dispenser 100 to dispense a dose of fluid if the door is open. Door circuitry 140 may be any type of circuitry, such as, for example, a mechanical switch, a magnetic switch, a proximity switch or the like.

Processor 132 is also in circuit communication with an object sensor 142 for detecting whether an object is present in the dispense area. Object sensor 142 may be any type of passive or active object sensor, such as, for example, an infrared sensor and detector, a proximity sensor, an imaging sensor, a thermal sensor or the like.

In addition, processor 132 is in circuit communication with optional pulse width modulation circuitry 180. Pulse width modulation circuitry 180 is in circuit communication with switching device 182. In this exemplary embodiment, switching device 182 is in circuit communication with capacitor bank 145 and motor 150. In some embodiments, switching device 182 is in circuit communication with an a different power source (not shown) alone or in combination with the optional capacitor bank 145. In some embodiments, capacitor bank 145 is replaced with one or more batteries, and/or one or more rechargeable batteries. During operation, processor 132 provides one or more signals to pulse width modulation circuitry 180, which causes pulse width modulation circuitry 180 to control switching device 182 to modulate the power provided by capacitors 145 to drive the motor 150. More detailed descriptions of the modulated power signals are described below. Motor 148 (and any associated gearing) operate foam pump 190 (which may be a liquid pump in some embodiments).

In this exemplary embodiment, dispenser 100 includes an encoder 152. Encoder 152 may be, for example, an optical encoder. In some embodiments, encoder 152 provides an output to processor 132 at least about 4 times per revolution of the motor 150. In some embodiments, encoder 152 provides an output to processor 132 at least about 8 times per revolution of the motor. In some embodiments, encoder 152 provides an output to processor 132 at least about 16 times per revolution of the motor. In some embodiments, encoder 152 is an 4-slot optical encoder. In some embodiments, encoder 152 is an 8-slot optical encoder. In some embodiments, encoder 152 is a 16-slot encoder. Encoder 152 is used to accurately count the rotations and/or fractions thereof of the motor 150. In some embodiments the encoder 152 is used to accurately count the rotations and/or fractions thereof of the pump 190.

In this exemplary embodiment, dispenser 100 also includes an optional brake 154. Optional brake 154 may be used to stop the motor 150 and/or pump 190 after the required number of rotations and/or fractions thereof have been reached, indicating that a precise dose size/volume has been dispensed. Absent a brake 154, the motor 150 may continue to rotate (or free-wheel) and cause more fluid to be dispensed then desired. In addition, various factors may affect the amount of free-wheel rotation, such as, for example, motor speed, vacuum pressure in the fluid container 112, drive voltages and the like. Accordingly, the amount of free-wheel travel may differ from dispense to dispense and may differ from time to time based upon drive voltage, vacuum pressure in container, and the like. Use of an optional brake 154 is one way to mitigate and/or prevent variations in volume dose sizes between individual dispenses due to free-wheel travel. In some embodiments, free-wheel travel is consistent and may be accounted for in determining the number of rotations and/or fractions thereof that are required for the precise dose volume, and in such embodiments, the optional brake 154 may not be needed.

In some embodiments, brake 154 is a mechanical brake. A conventional brake may include, for example, a rotor (not shown) on the motor shaft (not shown) that is gripped by one or more brake pads (not shown) to stop the motor. In some embodiments, brake 154 is an electrical brake or a dynamic brake. Exemplary embodiments of electrical or dynamic brakes are shown and described with reference to FIGS. 7-9.

Figure 2:
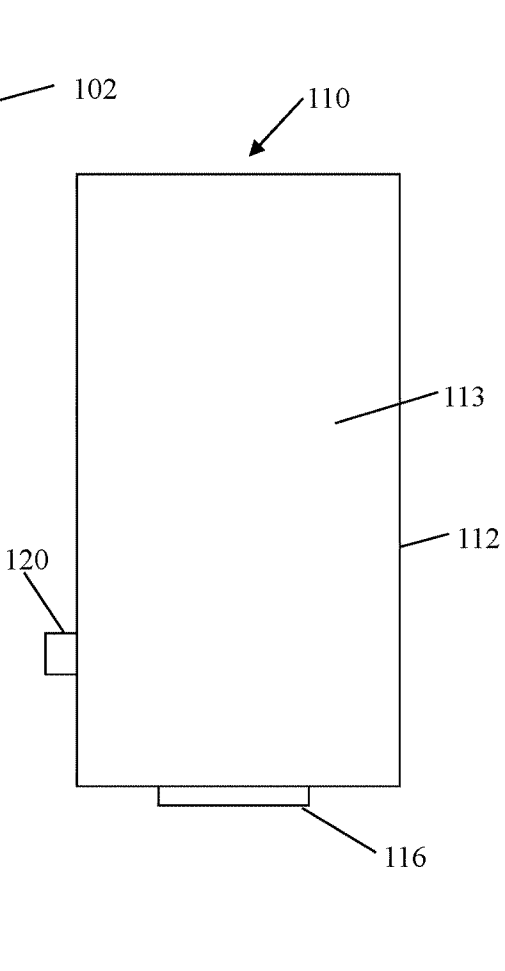
FIG. 2 is an exemplary removable refill unit.

In this exemplary embodiment, refill unit 110 is shown in phantom lines inserted in the dispenser 100 in FIG. 1 and is also illustrated in solid lines in FIG. 2. Thus, this illustrates that refill unit 110 is readily inserted into dispenser 100 and removed from dispenser 100 as a unit. Refill unit 110 includes a container 112 and a closure 116. In some embodiments, container 112 is a non-collapsing container and a vent (not shown) is included in closure 116 to allow air to flow into the container and prevent collapsing of container 112. In some embodiments, container 112 is a collapsible container and collapses as fluid if removed from the container 112. In some embodiments, refill unit 110 also includes a foamable liquid 113, such as, for example, a foamable soap, sanitizer, lotion, moisturizer or other foamable liquid used for personal hygiene. In some embodiments, refill unit 110 is for use in a liquid dispenser, rather than a foam dispenser, and filled with liquid that is not foamed or may not be foamable, such as, for example, soap, sanitizer, lotion, moisturizer or other liquid used for personal hygiene.

In addition, in in some embodiments refill unit 110 includes an optional replaceable energy source 120. Replaceable energy source 120 may be any power source, such as, for example, a battery, such as, for example, a single "AA" battery, a coin cell battery, a 9 volt battery or the like. In some embodiments, the replaceable energy source 120 does not contain enough power to directly power motor 150 (and any associated gearing) to dispense the contents of the refill unit 110.

Replaceable energy source 120 is inserted into dispenser 100 with refill unit 110 and is removed from dispenser 100 with refill unit 110. Preferably refill unit 110 has replaceable energy source 120 affixed thereto; however, in some embodiments, the replaceable energy source 120 is provided separately along with the refill unit 110. In either case, however, generally the replaceable energy source 120 is provided with and removed with or at the same time as the refill unit 110. In some embodiments, refill unit 110 does not have a replaceable power source and the dispenser 100 receives sufficient power to dispense the contents of refill unit 110 without receiving power from the refill unit 110.

In this exemplary embodiment, system circuitry 130 also includes a bank of capacitors 145 and capacitor control circuitry 146 in circuit communication with processor 132. The bank of capacitors 145 and capacitor control circuitry 146 is in circuit communication with replaceable energy source interface receptacle 144 and PWM switch 182. Replaceable energy source interface receptacle 144 is configured to receive and/or otherwise electrically couple with replaceable energy source 120 when refill unit 110 is inserted in the dispenser 100. In some embodiments, the capacitors and capacitor circuitry are replaced with one or more batteries.

In some embodiments, during operation, when a refill unit 110 is inserted into dispenser 100, processor 132 and capacitor control circuitry 146 cause the bank of capacitors 145 to charge in parallel. In some exemplary embodiments, there are two or more capacitors. In some embodiments the capacitors are oversized for the required power to power the motor 150 and associated gearing to dispense a dose of foam. Oversized capacitors are preferably charged to a level that is less than the rated voltage of the capacitors. Because the bank of capacitors 145 is charged to less than full capacity, there is less discharge in the capacitors when they are idle for a period of time. In some embodiments, the capacitors are charged to less than about 50% of their full capacity. In some embodiments, the capacitors are charged to less than about 75% of their full capacity. In some embodiments, the capacitors are charged to less than about 90% of their full capacity.

When the processor 132, through object sensor 142, determines that an object is within the dispense zone, the processor 132 causes the capacitor control circuitry 146 to place the capacitors 145 in series to provide power to switching device 182, the switching device 182 in coordination with the pulse width modulation circuitry 180 provide modulated power to power the motor 150 to operate foam pump 190. Once a dose has been dispensed, processor 132 checks the charge on the capacitors 145. If the charge is below a threshold, the processor 132 causes the capacitor control circuitry 146 to charge the capacitors 145. The capacitors 145 are charged in parallel.

In some embodiments, the processor 132 monitors the amount of fluid left in the refill unit 110. The processor 132 may monitor the amount of fluid by detecting the fluid level, for example, with a level sensor, with a proximity sensor, with an infrared detection, by counting the motor rotations, which allows for a precise volume of fluid removed from the refill unit 110 to be determined and comparing that to the total volume of fluid in the refill unit or the like. In some embodiments, the a value indicative of the volume of fluid removed from the refill unit is stored on the refill unit 110 so if that refill unit is moved to a different dispenser, the dispenser can determine the amount of fluid remaining in the refill unit 110.

In some embodiments, when the processor 132 determines that the refill unit 110 is empty, or close to being empty, the processor 132 causes the replaceable energy source 120 to charge the capacitors 145 up to their maximum charge, or to charge the capacitors 145 up until the replaceable energy source 120 is completely drained or drained as far as possible. Thus, when the refill unit 110 and replaceable energy source 120 is removed, as much energy as possible has been removed from the replaceable energy source 120.

Although the exemplary dispenser 100 is shown and described with capacitors as a power source, other types of power sources may be used, such as, for example, rechargeable batteries. Additional exemplary dispensers as well as more detail on the circuitry for the touch free dispenser described above is more fully described and shown in U.S. patent application Ser. No. 13/770,360 titled Power Systems for Touch Free Dispensers and Refill Units Containing a Power source, filed on Feb. 19, 2013 which is incorporated herein by reference in its entirety.

Figure 3:
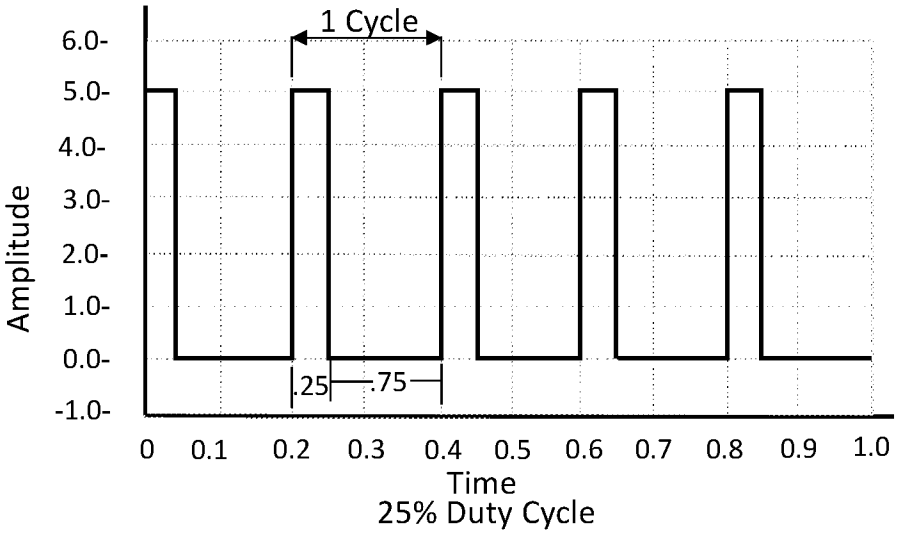
FIGS. 3 and 4 are exemplary illustrations of pulse width modulated duty cycles for driving a dispenser motor.
Figure 4:
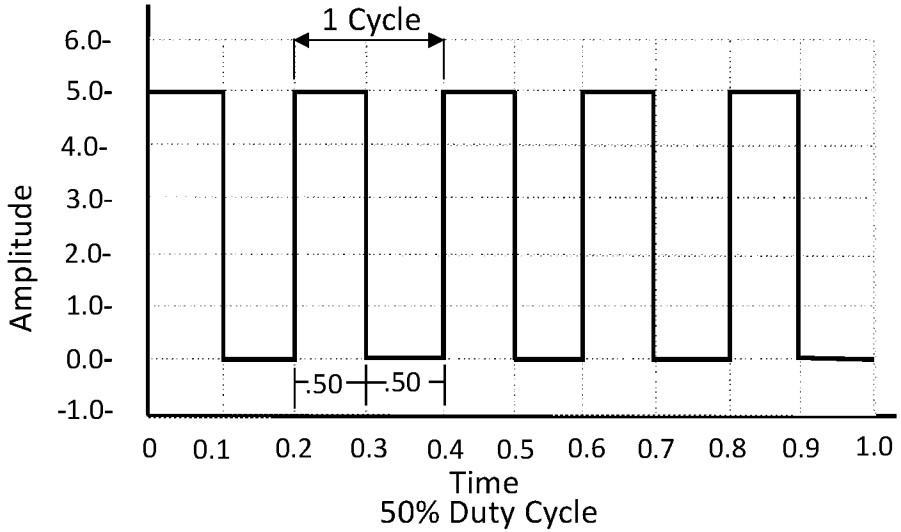

FIG. 3 illustrates an exemplary waveform output by pulse width modulation circuitry 180 and switching device 182. In this exemplary embodiment, the voltage is 5 volts and one cycle is 0.2 seconds. The wave form represents a 25% duty cycle, which means that the motor receives voltage pulses that are approximately 0.05 seconds long at about 5 volts followed by 0.15 seconds of substantially no voltage. Similarly, FIG. 4 illustrates another exemplary waveform output by pulse width modulation circuitry 180 and switching device 182. In this exemplary embodiment, the voltage is 5 volts and one cycle is 0.2 seconds. The waveform represents a 50% duty cycle, which means that the motor receives voltage pulses that are approximately 0.1 seconds long at about 5 volts followed by 0.1 seconds of substantially no voltage. Any suitable duty cycle may be used. Typically, the duty cycle is greater than a 10% duty cycle. In addition, the duty cycle need not be consistent for an entire dispense cycle. For example, if a dispense cycle is 1 second, the wave form may start out at a 25% duty cycle and increase to, for example, a 90% duty cycle as the load increases, and drop back down to a 25% duty cycle as the load decreases.

Exemplary duty cycles may be from between a 10% duty cycle to a 100% duty cycle. Preferably, the duty cycle is between about 40% and about 95%.

The pulse widths or duty cycle may be rapidly changed by processor 132 to control the speed of motor 150. In this exemplary embodiment, the pump 190 is a sequentially activated diaphragm pump. In this exemplary embodiment, the pump 190 has 4 diagrams. On diaphragm pumps liquid and the other 3 diaphragms pump air. The air and liquid are mixed together to form a foam that is dispensed out of the dispenser.

In this particular embodiment, the motor 150 directly drives the pump 192. Accordingly, the speed of the motor 150 is the same speed as the speed of the pump. In some embodiments, one or more gears or the like may be used to increase or decrease the speed of the pump with respect to the motor.

In some exemplary embodiments, it may be desired to control the speed of the motor to a set or selected speed. The set or selected speed may be, for example, a speed in between about 1300 revolutions per minute ("RPMs") and about 2200 RPMs. In some embodiments, the set speed may be, for example, a speed in between about 1300 RPMs and about 2100 RPMs. In some embodiments, the set speed may be, for example, a speed in between about 1400 RPMs and about 2000 RPMs. In some embodiments, the set speed may be, for example, a speed in between about 1500 RPMs and about 1900 RPMs. In some embodiments, the set speed may be, for example, a speed in between about 1600 RPMs and about 1800 RPMs.

In the following exemplary embodiment, the set speed has been selected to be about 1700 RPMs (or about 28.3 revolutions per second). The pulse width signal is selected to drive the motor 150 at 1700 RPMs, which in turn drives the pump 190 at 1700 RPMs for a sufficient time to deliver the desired volume dose of fluid. In this exemplary embodiment, the pump 190 delivers the desired volume dose of fluid in 18 revolutions of the pump 190 and motor 150. In this exemplary embodiment, the pulse width signal is set at 90% for the first ½ to ⅝ revolutions of the motor 190. After the motor begins to rotate, the pulse width is adjusted based on the actual speed of the motor. The encoder 152 provides feedback to the processor 132 indicative of the speed of the motor 150 and the cumulative revolutions. In this particular embodiment, the encoder 152 is an 8 slot optical encoder and provides feedback to the processor 8 times per revolution of the motor 150. If the motor speed is higher than 1700 RPMs, the width of the pulse is decreased. If the motor speed is lower than 1700 RPMs, the width of the pulse is increased. In some embodiments, the feedback signal is delivered to the processor 132 four or more times per revolution. Receiving motor speed feedback and controlling the speed permits the processor 132 provide a more consistent output.

In addition, the processor 132 may use the signals received from the encoder 152 to precisely control the volume of the output by ensuring that the motor 150 and or pump 190 rotate a precise number of rotations and/or fractions thereof. Accordingly, the pump 190 will dispenses substantially the exact same volume of fluid every time. The term "substantially" as used herein means about +/−0.1 milliliters of fluid. In preferred embodiments, both the speed of the motor and the number of motor/pump rotations are utilized to obtain very precise dispense outputs.

This precise output volume will be dispensed irrespective of factors, such as, for example, battery voltage, speed of the motor rotation, vacuum pressure in the refill unit, and the like. The length of time of the dispense may vary, however, the number of rotations remains constant. In some embodiments, the number of rotations of the pump is a number of rotations selected between 8 and 30. In some embodiments, the number of rotations of the pump is a number of rotations selected between 10 and 28. In some embodiments, the number of rotations of the pump is a number of rotations selected between 12 and 26. In some embodiments, the number of rotations of the pump is a number of rotations selected between 14 and 24. In some embodiments, the number of rotations of the pump is a number of rotations selected between 16 and 22. In some embodiments, the number of rotations of the pump is a number of rotations selected between 16 and 20. In some embodiments, the number of rotations of the pump is a number of rotations is 18.

Receiving of the number of revolutions (or portions thereof) of the motor and controlling the number of revolutions (or portions thereof) permits the processor 132 provide a more precise output volume. In addition, in some embodiments, controlling both speed of the motor and the number of revolutions, allows processor 132 to dispense a precise output volume in a precise amount of time.

In some embodiments, a stepper motor (not shown) is used. When a stepper motor is used, an encoder is not required. The stepper motor construction breaks a full rotation down into an equal number of "steps." Accordingly, the processor 132 may determine speed of the motor and/or the RPMs as a function of the steps, without the need for an encoder. In addition, the processor 132 may determine the number of rotations of the motor and/or pump based on the number of steps. As a result, irrespective of whether a stepper motor is used or an encoder is used, processor 132 receives speed and/or position feedback that allows it to control the speed and/or number of rotations of the motor.

Exemplary methodologies and logic diagrams are provided herein. Unless otherwise noted, additional blocks or steps may be included, fewer blocks or steps may be used, the blocks or steps may be performed in different orders, and one or more blocks from one methodology or logic diagram may be incorporated into the other methodologies or block diagrams.

Figure 5:
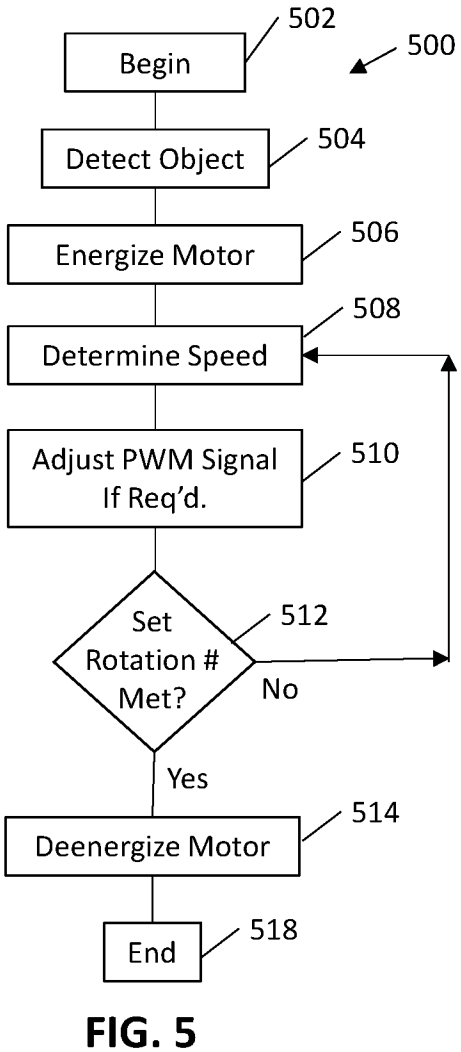
FIG. 5 is an exemplary methodology or logic flow diagram for precisely controlling a dose of fluid being dispensed.

FIG. 5 is an exemplary methodology or logic diagram 500 for controlling a dispenser. The exemplary methodology 500 begins at block 502. At block 504 an object is detected in the detection zone. The object is detected by an object sensor, such as, for example, an infrared ("IR") object sensor that includes an IR transmitter and an IR receiver. Upon detection of the object, a dispenser processor causes PWM circuitry to transmit power to the motor at block 506. The power transmitted by the PWM circuitry to the motor is a pulsed voltage, such as, for example, a voltage of about 5 volts. In some embodiments, initially, the voltage is pulsed according to a selected duty cycle. Preferably the selected duty cycle is greater than 90%. In this embodiment, for example, the initial duty cycle may be set at about 95%. Once the motor is energized at block 506, the processor begins receiving signals from a motor encoder that is connected to the motor. The motor encoder begins providing a plurality of signals to the processor for every full revolution of the motor. In some embodiments, the motor encoder provides four or more signals to the processor per full revolution. In some embodiments, the motor encoder provides eight or more signals to the processor per full revolution. In some embodiments, the motor encoder provides twelve or more signals to the processor per full revolution. In some embodiments, the motor encoder provides sixteen or more signals to the processor per full revolution. Preferably, prior to a full revolution, and more preferably prior to three fourths of a revolution, the processor begins to control the speed of the motor as a function of the signals provided by the encoder. At block 510, the processor determines the speed of the motor and compares the motor speed to a set or selected speed. In this exemplary embodiment, the selected speed may be, for example, 1800 RPMs. If at block 508, the processor determines that the measured speed is greater than 1800 RPMs, the width of the voltage pulse, or duty cycle, is reduced or decreased at block 512. If at block 508, the processor determines that the measured speed is less than 1800 RPMs, the width of the voltage pulse, or duty cycle, is widened or increased at block 508. At block 512 a determination is made as to whether a desired or set number of motor and/or pump revolutions or rotations have been completed. In this exemplary embodiment, the desired number or set number of motor revolutions or rotations is, for example, 18 full revolutions. If the set number, 18 in this exemplary embodiment, has not been reached, the logic or methodology loops back to block 508 where the speed of the motor is determined. In this manner, the processor may adjust the width of the voltage pulses multiple times during each revolution of the motor. If the set number has been reached, the methodology flows to block 514 where the processor causes the PWM circuitry to stop providing power to the motor, or deenergizes the motor and the methodology ends at block 518 or loops back to block 504.

Figure 6:
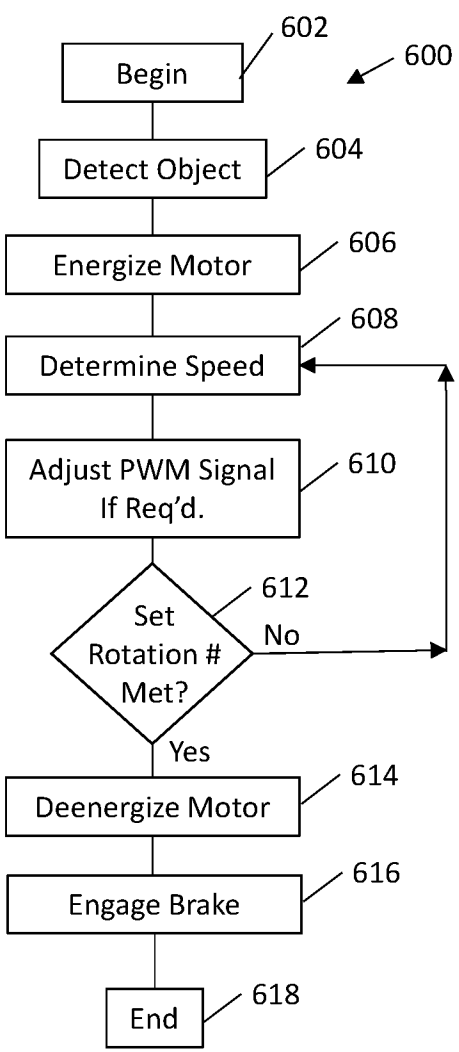
FIG. 6 is another exemplary methodology or logic flow diagram for precisely controlling a dose of fluid being dispensed.

FIG. 6 is an exemplary methodology or logic diagram 600 for controlling a dispenser. The exemplary methodology 600 begins at block 602. At block 604 an object is detected in the detection zone. The object is detected by an object sensor, such as, for example, an infrared ("IR") object sensor that includes an IR transmitter and an IR receiver. Upon detection of the object, a dispenser processor causes PWM circuitry to transmit power to the motor at block 606. The power transmitted by the PWM circuitry to the motor is a pulsed voltage, such as, for example, a voltage of about 5 volts. Initially, the voltage is pulsed according to a selected duty cycle. In this embodiment, for example, the initial duty cycle may be set at about 95%. Once the motor is energized at block 606, the processor begins receiving signals from a motor encoder that is connected to the motor. The motor encoder begins providing a plurality of signals to the processor for every full revolution of the motor. In some embodiments, the motor encoder provides four or more signals to the processor per full revolution. In some embodiments, the motor encoder provides eight or more signals to the processor per full revolution. In some embodiments, the motor encoder provides twelve or more signals to the processor per full revolution. In some embodiments, the motor encoder provides sixteen or more signals to the processor per full revolution. Preferably, prior to a full revolution, and more preferably prior to three fourths of a revolution, the processor begins to control the speed of the motor as a function of the signals provided by the encoder. At block 608, the processor determines the speed of the motor and compares the motor speed to a set or selected speed. In this exemplary embodiment, the selected speed may be, for example, 1800 RPMs. If at block 608, the processor determines that the measured speed is greater than 1800 RPMs, the width of the voltage pulse, or duty cycle, is reduced or decreased at block 610. If at block 608, the processor determines that the measured speed is less than 1800 RPMs, the width of the voltage pulse, or duty cycle, is widened or increased at block 610. At block 612 a determination is made as to whether a desired or set number of motor or pump revolutions have been completed. In this exemplary embodiment, the desired number or set number of motor revolutions is, for example, 18 full revolutions. If the set number, 18 in this exemplary embodiment, has not been reached, the logic or methodology loops back to block 608 where the speed of the motor is determined. In this manner, the processor may adjust the width of the voltage pulses multiple times during each revolution of the motor. If the set number of rotations or revolutions have been reached, the methodology flows to block 614 where the processor causes the PWM circuitry to stop providing power to the motor, or deenergizes the motor. At block 616, a brake is engaged manually or through an electric braking circuit. The brake stops the motor and associated pump very quickly. Accordingly, the brake ensures that the pump rotated a precise number of rotations and thus, dispensed a precisely controlled dose of fluid. The exemplary embodiment ends at block 618 or loops back to block 604.

Figure 7:
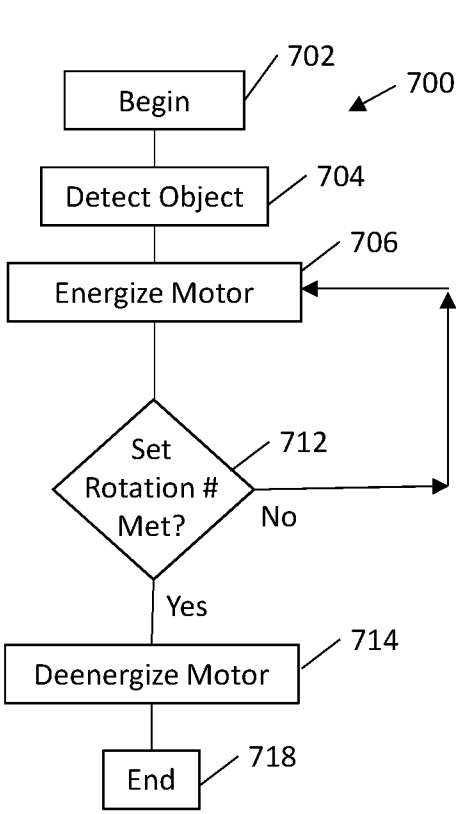
FIG. 7 is yet another exemplary methodology or logic flow diagram for precisely controlling a dose of fluid being dispensed.

FIG. 7 is an exemplary methodology or logic diagram 700 for controlling a dispenser. The exemplary methodology 700 begins at block 702. At block 704 an object is detected in the detection zone. The object is detected by an object sensor, such as, for example, an infrared ("IR") object sensor that includes an IR transmitter and an IR receiver. Upon detection of the object, a dispenser processor causes drive circuitry to transmit power to the motor at block 706. A motor encoder begins providing a plurality of signals to the processor for every full revolution of the motor. In some embodiments, the motor encoder provides four or more signals to the processor per full revolution (four signals, would be, for example, 1 signal for every quarter rotation). In some embodiments, the motor encoder provides eight or more signals to the processor per full revolution. In some embodiments, the motor encoder provides twelve or more signals to the processor per full revolution. In some embodiments, the motor encoder provides sixteen or more signals to the processor per full revolution. At block 712 a determination is made as to whether a desired or set number of motor and/or pump revolutions or rotations have been completed. In this exemplary embodiment, the desired number or set number of motor revolutions or rotations is, for example, 18 full revolutions. If the set number, 18 in this exemplary embodiment, has not been reached, the logic or methodology loops back to block 706 and the motor is continued to be energized. If the set number has been reached, the methodology flows to block 714 where the processor causes the drive circuitry to stop providing power to the motor, or deenergizes the motor and the methodology ends at block 718 or loops back to block 704. In some embodiments, the motor is stopped by applying a brake or dynamic braking of the motor.

Figure 8:
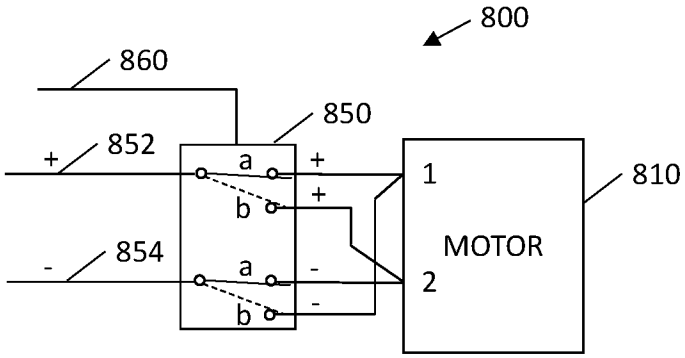
FIGS. 8-10 are exemplary brake circuits for stopping the dispenser motor.

FIG. 8 is an exemplary embodiment of an electronic braking circuit 800. This exemplary embodiment includes a motor 810 and a double pole switch 850. Double pole switch 850 is controlled by a processor (not shown) via control signal 860. When switch 850 is in position "a" (indicated by solid lines) and the motor 810 is energized, positive voltage on power line 852 is connected to terminal 1 of motor 810 and a negative (or neutral) voltage on power line 854 is connected to terminal 2 of motor 810. When motor 810 has turned the set number of revolutions, the processor (not shown) momentarily moves switch 850 to the "b" position. In addition, the processor (not shown) turns off power to lines 852 and 854. Momentarily moving the switch to the "b" position, momentarily applies a positive voltage to terminal 2 of motor 810 and applies a negative (or neutral) voltage to terminal 1. The switch 850 is in the "b" position long enough to stop the motor, but not long enough for the motor 810 to start rotating backwards. Once motor 810 stops, the switch is moved back to the "a" position.

Figure 9:
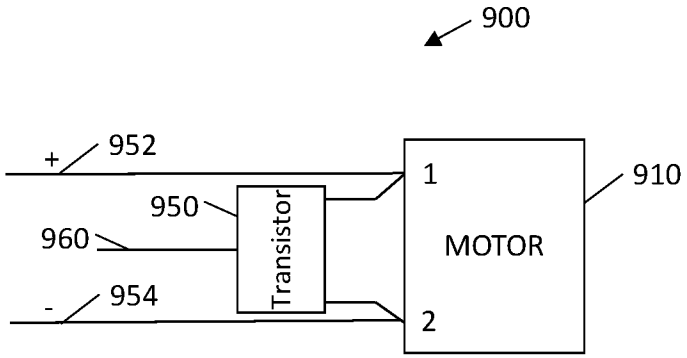

FIG. 9 is an exemplary embodiment of an electronic braking circuit 900. This exemplary embodiment includes a motor 910 and a transistor 950. Transistor 950 is controlled by a processor (not shown) via control signal 960. When the motor 910 is energized, positive voltage on power line 952 is connected to terminal 1 of motor 910 and a negative (or neutral) voltage on power line 954 is connected to terminal 2 of motor 910. When motor 910 has turned the set number of revolutions, the processor (not shown) turns off power to lines 852 and 854 and momentarily turns on transistor 950. Turning on transistor 950 provides a short circuit across motor terminals 1 and 2, which stops the motor 910. Once the motor 910 stops, transistor 950 is turned off.

Figure 10:
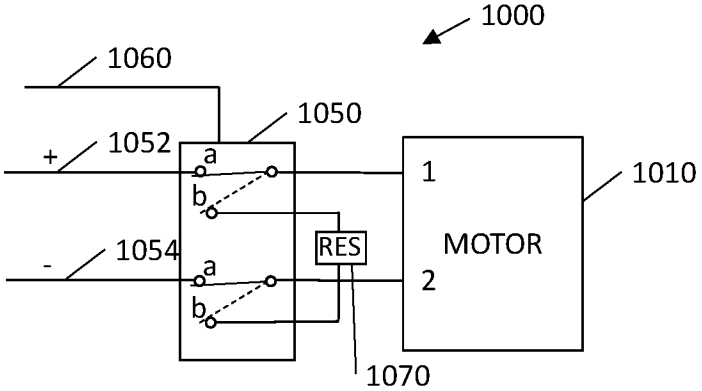

FIG. 10 is an exemplary embodiment of an electronic braking circuit 1000. This exemplary embodiment includes a motor 1010, a double pole switch 1050, and a resistor 1070. Double pole switch 1050 is controlled by a processor (not shown) via control signal 1060. When switch 1050 is in position "a" (indicated by solid lines) and the motor 1010 is energized, positive voltage on power line 1052 is connected to terminal 1 of motor 1010 and a negative (or neutral) voltage on power line 1054 is connected to terminal 2 of motor 1010. When motor 1010 has turned the set number of revolutions, the processor (not shown) moves switch 1050 to the "b" position. In addition, the processor (not shown) turns off power to lines 1052 and 1054. Moving the switch 1050 to the "b" position places resistor 1070 across motor 1010 terminals 1 and 2 stopping motor 1010. Once motor 1010 stops, switch 1050 is moved back to the "a" position.

Figure 11:
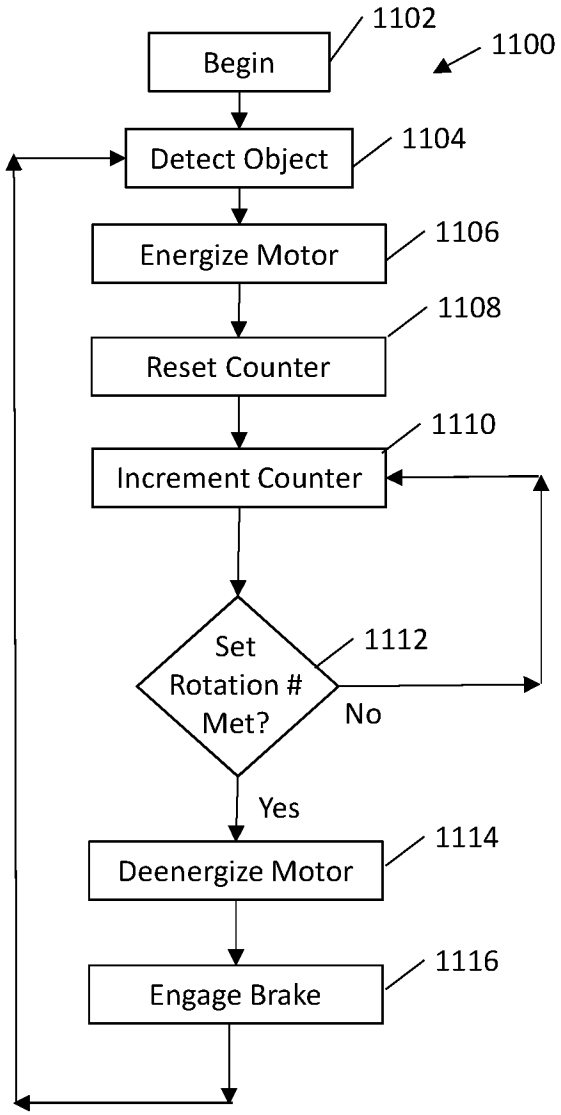
FIG. 11 is yet another exemplary methodology or logic flow diagram for precisely controlling a dose of fluid being dispensed.

FIG. 11 is an exemplary methodology or logic diagram 1100 for controlling a dispenser. The exemplary methodology 1100 begins at block 1102. At block 1104 an object is detected in the detection zone. The object is detected by an object sensor, such as, for example, an infrared ("IR") object sensor that includes an IR transmitter and an IR receiver. Upon detection of the object, a dispenser processor causes drive circuitry to transmit power to the motor at block 1106. A counter is reset at block 1108. At block 1110 the counter 1110 is incremented. At block 1112 a determination is made as to whether the set number of rotations have been met. If at block 1112 it is determined that the set number of rotations have not been met, once a full revolution is made, the methodology loops back to block 1110 and the counter is incremented and the methodology flows to block 1112. If at block 1112 a determination is made as to whether the set number of rotations has been met. If the set number of rotations have been met, the motor is deenergized at block 1114. At block 1116 brake is engaged. In some embodiments, the motor is stopped by applying a brake. The brake may be a mechanical brake or an electrical brake.

While various inventive aspects, concepts and features of the inventions may be described and illustrated herein as embodied in combination in the exemplary embodiments, these various aspects, concepts and features may be used in many alternative embodiments, either individually or in various combinations and sub-combinations thereof. It is not the intention of the applicant to restrict or in any way limit the scope of the appended claims to such detail. Unless expressly excluded herein, all such combinations and sub-combinations are intended to be within the scope of the present inventions. Still further, while various alternative embodiments as to the various aspects, concepts and features of the inventions—such as alternative materials, structures, configurations, methods, circuits, devices and components, software, hardware, control logic, alternatives as to form, fit and function, and so on—may be described herein, such descriptions are not intended to be a complete or exhaustive list of available alternative embodiments, whether presently known or later developed. Those skilled in the art may readily adopt one or more of the inventive aspects, concepts or features into additional embodiments and uses within the scope of the present inventions even if such embodiments are not expressly disclosed herein. Additionally, even though some features, concepts or aspects of the inventions may be described herein as being a preferred arrangement or method, such description is not intended to suggest that such feature is required or necessary unless expressly so stated. Still further, exemplary or representative values and ranges may be included to assist in understanding the present disclosure; however, such values and ranges are not to be construed in a limiting sense and are intended to be critical values or ranges only if so expressly stated. Moreover, while various aspects, features and concepts may be expressly identified herein as being inventive or forming part of an invention, such identification is not intended to be exclusive, but rather there may be inventive aspects, concepts and features that are fully described herein without being expressly identified as such or as part of a specific invention. Descriptions of exemplary methods or processes are not limited to inclusion of all steps as being required in all cases, nor is the order in which the steps are presented to be construed as required or necessary unless expressly so stated.

We claim:

1. A method of dispensing soap or sanitizer comprising:
providing a dispenser having a container for holding fluid, a motor, a pump driven by the motor, a power source, an object sensor, a processor, an encoder and pulse width modulation circuitry;
detecting the presence of an object by the object sensor;
causing the pulse width modulation circuitry to output a power signal with a first duty cycle to the motor for at least a fraction of at least one rotation of the motor;
receiving a plurality of signals from the encoder;
determining a speed of the motor;
changing from the first duty cycle to one or more second duty cycles to cause the speed of the motor to approach a selected motor speed;
wherein when the pump is driven by the motor, a fluid is pumped out of the dispenser;
determining a number of revolutions of the motor as a function of receiving the plurality of signals from the encoder;
causing the pulse with modulation circuitry to stop providing power to the motor upon determining a selected number of revolutions of the pump have occurred.

2. The method of claim 1 further comprising braking the motor.

3. The method of claim 2 wherein breaking the motor comprises using a transistor that short circuits a pair of motor terminals to stop the motor.

4. The method of claim 2 wherein breaking the motor comprises using a switch to switch the voltage polarity across a pair of motor terminals.

5. The method of claim 2 wherein breaking the motor comprises using a switch and a resistor, wherein the switch is switched to place the resistor across a pair of motor terminals to stop the motor.

6. A method of dispensing soap or sanitizer comprising:
providing a dispenser having a container for holding soap or sanitizer, a motor, a pump driven by the motor, a power source, an object sensor, a processor and an encoder;
detecting the presence of an object by the object sensor;
applying power to the motor to cause rotation of the pump;
receiving a plurality of signals from the encoder that are indicative of the position of the motor;
wherein when the pump is driven by the motor,
wherein the fluid is pumped out of the dispenser;
determining a number of revolutions of the pump;
deenergizing the motor after a set number of revolutions of the pump, wherein the set number of revolutions is greater than about 5.

7. The method of claim 6 wherein the number of revolutions is less than about 30.

8. The method of claim 6 further comprising applying a brake to stop the motor.

9. The method of claim 6 wherein applying the brake comprises applying a mechanical brake.

10. The method of claim 6 wherein applying the brake comprises applying an electrical brake.

11. A soap or sanitizer dispenser comprising:
a housing;
a container for holding fluid;
a pump in fluid communication with the interior of the container;
a dispenser processor;
a power source;
a stepper motor;
wherein each full rotation of the stepper motor is divided into a number of equal steps;
wherein the processor determines a number of rotations of the stepper motor as a function of the equal steps;
wherein the processor determines a speed of the stepper motor as a function of the equal steps;
pulse width modulation circuitry in circuit communication with the power source and the stepper motor; and
wherein the pulse width modulation circuitry adjusts the duty cycle to maintain a selected motor speed; and
wherein the processor causes the motor to stop after a set number of rotations of the stepper motor.

12. The soap or sanitizer dispenser of claim 11 further comprising circuitry configured to maintain the speed of the stepper motor at a selected speed.

13. The soap or sanitizer dispenser of claim 11 further comprising a brake.

14. The soap or sanitizer dispenser of claim 13 wherein the brake comprises a transistor that short circuits a pair of motor terminals to stop the stepper motor.

15. The soap or sanitizer dispenser of claim 13 wherein the brake comprises a switch, wherein the switch switches the voltage polarity across a pair of motor terminals.

16. The soap or sanitizer dispenser of claim 13 wherein the brake comprises a switch and a resistor, wherein the switch places the resistor across a pair of motor terminals to stop the motor.

17. The soap or sanitizer dispenser of claim 13 wherein the set number of rotations of the motor is greater than about 5 rotations.

18. The soap or sanitizer dispenser of claim 13 wherein the set number of rotations of the motor is less than about 30 rotations.

19. The soap or sanitizer dispenser of claim 13 wherein the processor determines the speed of the motor a plurality of times throughout each rotation of the motor.

20. The soap or sanitizer dispenser of claim 13 wherein the pule width modulation circuitry adjusts the duty cycle to maintain a selected speed as a function of the determined speed of the motor after the at least a fraction of one rotation of the motor.

* * * * *